US006711788B1

(12) United States Patent
Chen

(10) Patent No.: US 6,711,788 B1
(45) Date of Patent: Mar. 30, 2004

(54) MODIFIED STRUCTURE OF A TELESCOPIC BELT BUCKLE

(76) Inventor: Sin-Hsing Chen, No. 3, 73 Lane Chingshin St., Taipei Hsien (TW)

( * ) Notice: Subject to any disclaimer, the term of this patent is extended or adjusted under 35 U.S.C. 154(b) by 0 days.

(21) Appl. No.: 10/212,189

(22) Filed: Aug. 5, 2002

(51) Int. Cl.[7] ..... A44B 1/04

(52) U.S. Cl. ..... 24/181; 24/190; 24/173; 24/163 R; 24/265 BC; 2/322

(58) Field of Search ..... 24/173, 180, 181, 24/190, 163 R, 265 BC, 316; 2/322

(56) References Cited

U.S. PATENT DOCUMENTS 1,619,138 A * 3/1927 Kollstede ..... 24/180
2,388,752 A * 11/1945 Loos ..... 24/163 R
3,150,427 A * 9/1964 Rossi ..... 24/163 R
4,996,751 A * 3/1991 Keum ..... 24/181 X
5,673,463 A * 10/1997 Chih-wen ..... 24/265 BC
6,108,821 A * 8/2000 Malsoute ..... 24/265 BC X
6,393,671 B1 * 5/2002 Chen ..... 2/322 X

* cited by examiner

*Primary Examiner*—Robert J. Sandy
(74) *Attorney, Agent, or Firm*—Harrison & Egbert

(57) ABSTRACT

A modified structure of a telescopic belt buckle includes a spring compartment in the belt buckle body, and a latch located at the end of the spring to link the head of the belt, which is allowed to slide along the compartment and reach the belt fastening the human body with specific length for extension. As both the thickness of the belt equals the space taken by the spring, the compartment is thus provided with enough space for telescopic movement of the most slim and simple buckle.

3 Claims, 4 Drawing Sheets

MODIFIED STRUCTURE OF A TELESCOPIC BELT BUCKLE

RELATED U.S. APPLICATIONS

STATEMENT REGARDING FEDERALLY SPONSORED RESEARCH OR DEVELOPMENT

REFERENCE TO MICROFICHE APPENDIX

FIELD OF THE INVENTION

The present invention relates to a telescopic belt buckles. More particularly, the present invention relates to a telescopic belt buckle in which a compartment in the belt buckle conceals a small piece of a tip of the belt so as to receive a spring that allows the belt to telescope within this compartment.

BACKGROUND OF THE INVENTION

Conventional belts come in a fixed length. After the belt is positioned around the waist of the user, this fixed length tends to be unexpandable with the flexible movements of the human body. The waist size of any given person can vary slightly over the course of a single day. The difference in waist size before and after a meal can be noticed. Some persons will feel slightly uncomfortable with a tightly fastened belt. As a result, adjustment of the belt is necessary.

In the past, a large number of telescopic belt buckles have been developed. Virtually all of these telescopic belt buckles have the belt buckle fixed at one end of the belt while a spring, along with other elements, are also included in the belt so as to allow the belt to be expandable. In particular, there is a sliding and hooking block used to latch the hole at the end of the belt. The entire assembly of the hook slides and allows the belt to move freely. Those prior art telescopic belt buckle that are available in the marketplace are mostly of a very complicated structured and are positioned at the end of the belt. As a result, the telescopic belt buckle is not compact, nor is it elegant.

The telescopic belt buckle of the present invention has a moving tip positioned at the beginning of the belt and not at the end of the belt. A small piece of the tip is concealed in the compartment of the belt buckle. This piece of the tip is joined to a spring so as to allow the space of the compartment to be fully used. The other elements, such as the latch and the fastening ring of the belt, remain fixed as used in conventional belts. Since the space in the compartment of the belt buckle is optimally used, the assembly of the present invention is simplified and lightweight. As a result, the buckle is more compact. This compact belt buckle will be satisfactory to most users' preferences.

BRIEF SUMMARY OF THE INVENTION

The present invention is a belt for men. The end of the belt is concealed within the buckle. The present invention also relates to a modified telescopic belt buckle that has the front end of the belt buckle attached with a ring. On the top of the ring, there is a latch or a pin in the center thereof that allows the hole at the end of the belt to be latched through the notch in the center of the ring prior to winding up above the belt buckle.

DETAILED DESCRIPTION OF THE INVENTION

Figure 1:
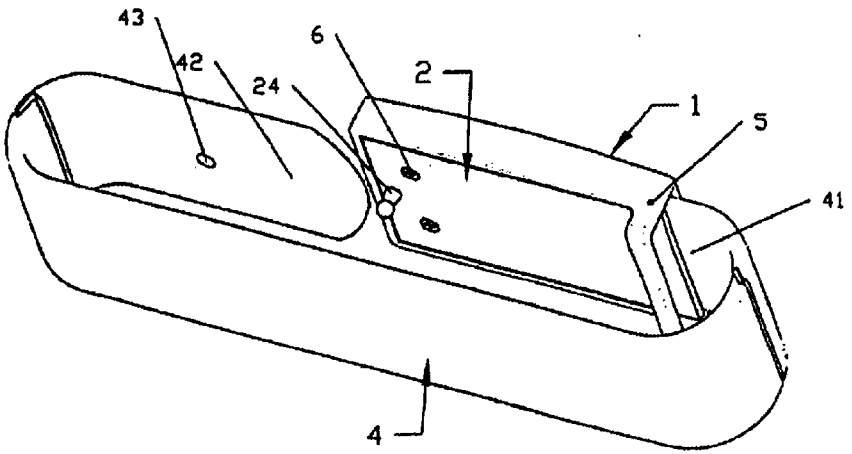
FIG. 1 is an upper perspective view of the telescopic belt buckle structure of the preferred embodiment of the present invention.

Referring to FIG. 1, the belt of the present invention includes a buckle unit 1. The buckle unit 1 includes a belt ring 14 at the one end thereof. A cover 2 is placed across an inside surface of the buckle unit 1. The cover 2 has a protruding latch 24. The belt 4 has a belt head 41 which passes through the belt ring 14 at one end of the buckle unit 1 while the other end 42 of the belt 4 winds up onto the opposite end of the buckle unit 1. As a result, a circular belt 4 is formed.

Figure 2:
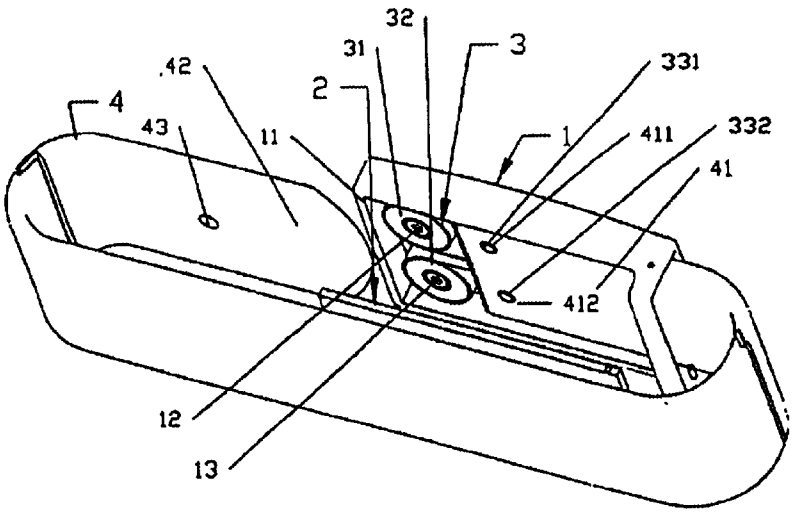
FIG. 2 is an interior perspective view with the cover removed showing the interior of the telescopic belt buckle of the present invention.
Figure 3:
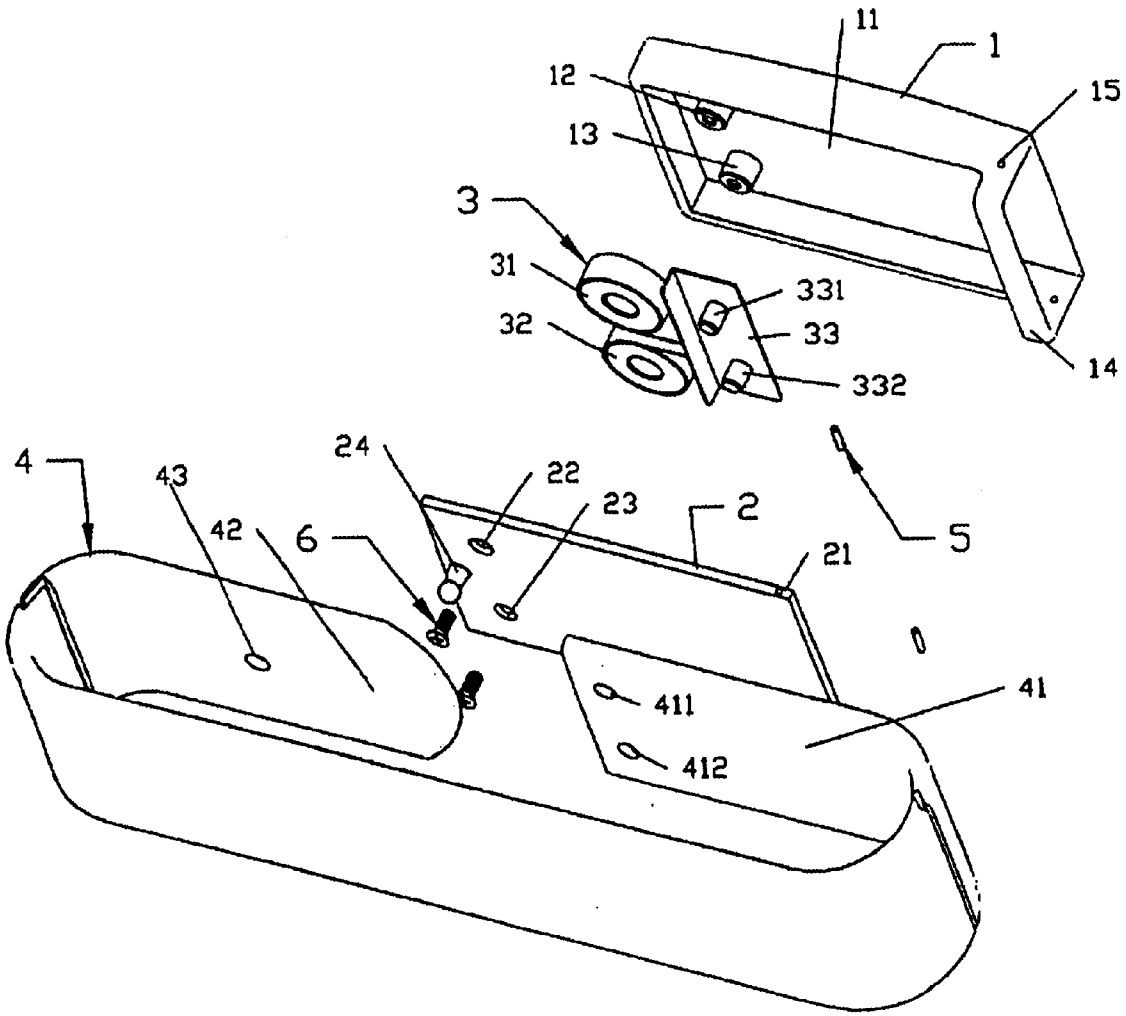
FIG. 3 is an exploded view of the telescopic belt buckle of the present invention.

FIG. 2 shows the interior construction of the buckle unit 1. The buckle unit 1 has a hollowed compartment 11 in an interior thereof. The belt ring 14 defines the exit of the hollowed compartment 11. The opposite end of the compartment 11 includes a spring unit 3 in the form of plate winding springs 31 and 32. The plate winding springs 3 land 32 are secured to the buckle unit 1. A cradle 33 extends from the spring unit 3 and is positioned against a bottom of the compartment 11. The belt head 41 is received within the compartment 11. The end of belt head 41 is engaged with the cradle 33 so as to allow free horizontal movement within the compartment 11. The cover 2 is placed over the spring unit 3 and across the compartment 11. The cover 2 divides the end of the belt ring 14 so as to allow the formation of the exit of the belt head 41 and an entry for the tip end 42 of the belt 4. FIG. 3 shows these elements in greater detail.

The buckle unit 1 is in the form of an elongated block with a back surface defining an interior portion of the compartment 11. Studs 12 and 13 protrude from back surface of the compartment 11. Each of the studs 12 and 13 include screw holes which allow screws to be secured thereto. The end of the buckle unit 1, defining the exit of the compartment 11, is in the form of an inverted block "U" configuration that extends outwardly so as to form the belt ring 14. A pair of pin holes 15 are formed on the opposite sides of the belt ring 14. The spring unit 3 includes a pair of winding springs 31 and 32. The centers of each of the winding springs 31 and 32 are fitted onto the studs 12 and 13 such that the studs 12 and 13 act as an axle cam for the pair of winding springs 31 and 32. One end of the pair of winding springs 31 and 32 is connected to the L-shaped cradle 33. One surface of the cradle 33 is positioned against the inside surface of the compartment 11. The cradle 33 has pins 331 and 332 protruding therefrom. The holes 411 and 412 on one end of the belt 41 are secured to the pins 331 and 332. The cover 2 is an elongated plate that has a latch 24 protruding from an outer surface thereof. Screw holes 22 and 23 are formed adjacent to the latch 24 so as to align with the studs 12 and 13. Pin holes 21 are formed at the outer edges of the cover 2. A pair of straight pins 5 engage the pin holes 15 of the plate and engage the pin holes 21 of the cover 2. Screws 6 pass through the screw holes 22 and 23 so as to secure the cover 2 onto the buckle unit 1 and into the studs 12 and 13.

Figure 4A:
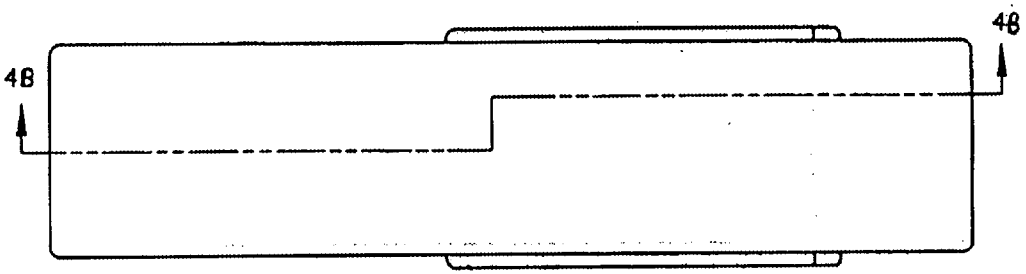
FIG. 4A is a plan view of the telescopic belt buckle of the present invention.
Figure 4B:
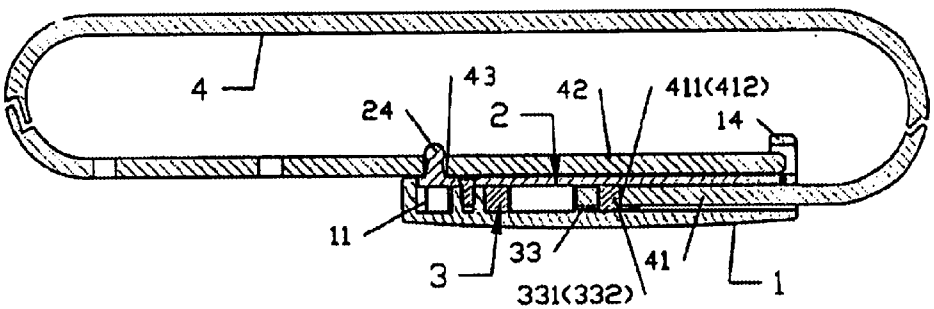
FIG. 4B is a cross-section view taken across lines 4B—4B of FIG. 4A showing the cross section of the telescopic belt buckle of the present invention.
Figure 4C:
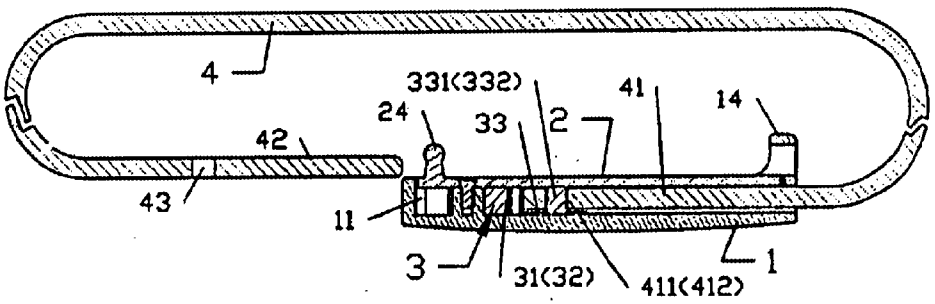
FIG. 4C is a cross-sectional view of the telescopic belt buckle of the present invention showing the belt buckle in an unlatched configuration.

FIGS. 4A–C show the assembled structure. The compartment 11 of the buckle unit 1 has springs 31 and 32, along with the cradle 33, engaged with the end of the belt 4. The cradle 33 has pins 331 and 332 engaged with the holes 411 and 412 in the head 41 of belt 4.The belt is inserted through the right exit at the belt ring 14 of the compartment 11. The cover 2 closes the hollowed out compartment buckle unit 1. The right end of the cover 2 is secured into the pin hole 15 by straight pins 5. This allows the belt ring 14 to form a guide for the end 42 of the belt 4. The belt end 42 can include a plurality of latch holes 43 so as to allow for the free setting onto the latch 24 on cover 2 by the user. As can be seen in FIG. 4B, the assembled belt 4 is withheld by the springs 31 and 32 from the belt end 41 for rightward extension and restoration (as shown in FIG. 4C) within a limited range. This allows the belt to have elasticity when latched.

Figure 5:
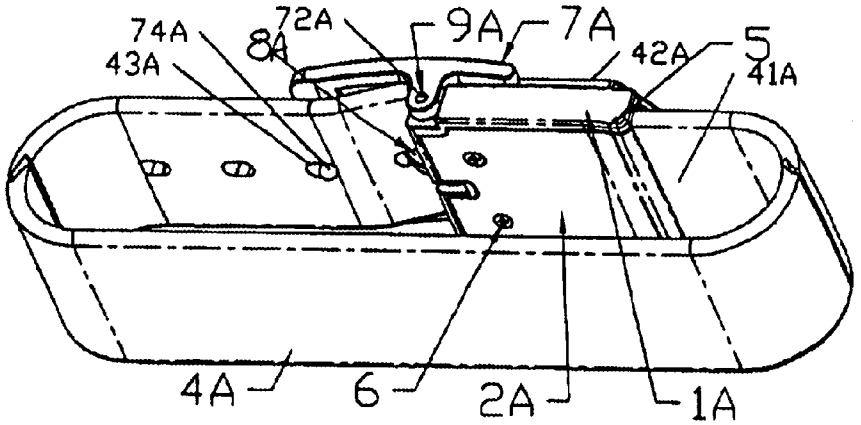
FIG. 5 is a perspective view of an alternative embodiment of the telescopic belt buckle of the present invention.

FIG. 5 shows an alternative embodiment of the outboard form of the present invention. A buckle unit 1A is attached with a latch 7A. The latch 7A has a retaining latch 74A. The latch 7A also has security pin 8A that is engaged into the latch hole 43A at the end of the belt 4A. This allows the belt end 42A to pass through the latch 7A before being positioned against the buckle unit 1A.

Figure 6:
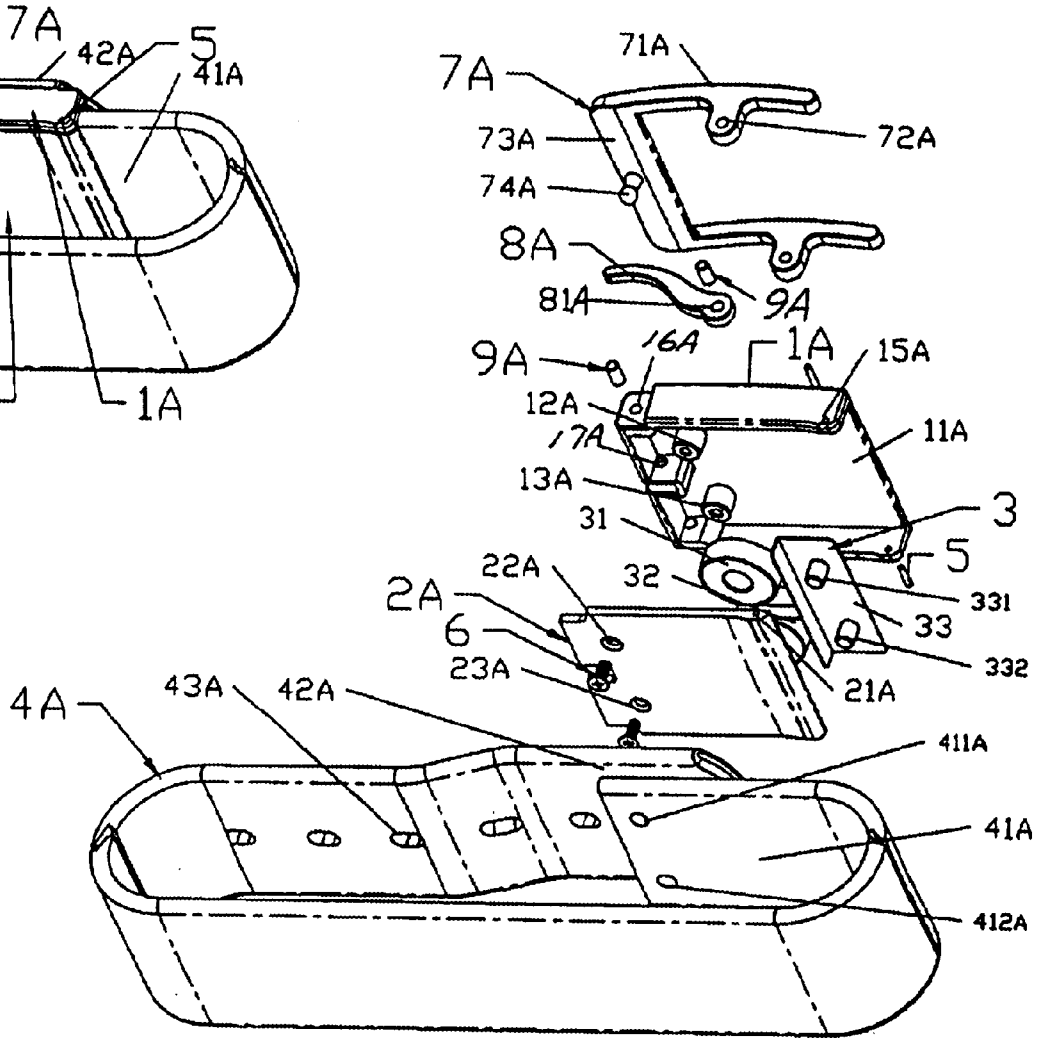
FIG. 6 is an exploded view of the telescopic belt buckle of the alternative embodiment of FIG. 5.

FIG. 6 shows an exploded view with the various elements of the belt buckle of the alternative embodiment of the present invention. Latch 7A, along a security pins 8A, are particularly illustrated in FIG. 6. The buckle unit 1A has a spring unit 3 and a cover 2A under the spring unit 3. The latch 7A is of a generally block U-shape which includes two side arms 71A and a cross pin 73A. An axle hole 72A is formed on each of the side arms 71A. A retaining latch 74A is located between the side arms 71A and extends below the cross pin 73A. The security pin 8A is a cantilever unit having one end with a transverse axle hole 81A. The buckle unit 1A has a compartment 11A on a bottom thereof. There are two protruding studs 12A and 3A at one end of the compartment 11A. There are also a pair of pin holes 15A on the bottom of the compartment 11A. The pin holes 15A pass through the two sides. An axle hole 16A and central axle hole 17A pass through both sides. The spring unit 3, as described earlier, is affixed onto the studs 12A and 13A in the buckle unit 1A. The head 41A has a pair of corresponding holes 41A and 412A for engagement onto the pins 331 and 332 of the spring cradle 33 in the manner of the preceding embodiment. One end of the cover 2A is secured with straight pin 5 onto the pin hole 15A of the buckle unit 1A. The opposite end of the cover 2A is secured onto the bottom of the buckle unit 1A by securing with screws 6 onto the studs a 12A and 13A. This allows the compartment 11A of buckle unit 1A to have only a right exit for the belt head 41A. The buckle unit 1A with in the compartment 11A will move horizontally along with the movement of the spring unit 3. The left end of the buckle unit 1A has an axle 9A secured within the axle hole 16A. The axle 9A secures a securing pin 8A onto the axle hole 17A in the middle of the left side of the unit. This allows the securing pin 8A to be secured into the buckle unit 1A against the retaining pin 7A. The latch 74A on the retaining ring 7A allows a pairing with the security pin 8A. In this alternative embodiment, the assembled belt buckle, as shown in FIG. 5, has a telescopic movement which can be conducted in the manner of the prior form of the present invention, specifically, by means of the spring unit 3 in the buckle unit 1A which guides the belt head for automatic adjustment within a specific length.

The present invention has the free end of the belt as a part of the belt head without void spaces. The free end is fully concealed into the belt buckle unit. During telescopic movement, the elements remain free from movement along with the user's body or clothing. The simple construction provides convenient manufacture, low cost and a desirable appearance.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A telescopic belt buckle apparatus comprising:

a belt having a free end and a fixed end;

a buckle unit having an exterior surface and a hollow interior, said buckle unit having a belt ring at one end thereof;

a spring assembly secured within said hollow interior of said buckle unit, said spring assembly having at least one spring and a cradle extending therefrom, said fixed end of said belt engaged with said cradle of said spring assembly and extending outwardly of said buckle unit through said belt ring, said cradle being slidable within said hollow interior of said buckle unit so as to move relative to the spring, said spring urging said cradle toward said spring; and a cover affixed to said buckle unit so as to extend over said spring assembly, said cover dividing an opening in said belt ring into an exit opening for said fixed end of said belt and into a separate entry opening for said free end of said belt, said cover having a latch protruding outwardly therefrom, said latch engageable with a hole formed in said free end of said belt, said buckle unit having a stud extending into said hollow interior, the spring being engaged with said stud at an opposite end of said buckle unit, said cradle secured to a free end of the spring.

2. The apparatus of claim 1, said buckle unit having an axle hole formed at a side thereof adjacent said opposite end, the apparatus further comprising:

a generally U-shaped ring engaged with said axle hole, said ring defining an opening therein with said buckle unit, said ring having a cross pin extending thereacross, said cross pin having a latch formed at a bottom thereof and extending outwardly therefrom, said latch engageable with the hole in said free end of said belt.

3. The apparatus of claim 2, further comprising:

a securing pin extending from said buckle unit outwardly so as to reside centrally on said cross pin.

* * * * *